US007762774B2

(12) United States Patent
Liang

(10) Patent No.: US 7,762,774 B2
(45) Date of Patent: Jul. 27, 2010

(54) COOLING ARRANGEMENT FOR A TAPERED TURBINE BLADE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 733 days.

(21) Appl. No.: 11/639,961

(22) Filed: Dec. 15, 2006

(65) Prior Publication Data

US 2008/0145236 A1 Jun. 19, 2008

(51) Int. Cl.
*F01D 5/08* (2006.01)

(52) U.S. Cl. ..... 416/97 R

(58) Field of Classification Search ..... 415/115; 416/92, 97 R

See application file for complete search history.

(56) References Cited

U.S. PATENT DOCUMENTS

| | | | | |
|---|---|---|---|---|
| 5,394,932 | A | 3/1995 | Carozza et al. | |
| 5,468,125 | A * | 11/1995 | Okpara et al. | 416/97 R |
| 5,591,007 | A * | 1/1997 | Lee et al. | 416/97 R |
| 5,779,447 | A * | 7/1998 | Tomita et al. | 416/97 R |
| 5,947,181 | A | 9/1999 | Davis | |
| 6,068,806 | A | 5/2000 | Dietrich | |
| 6,331,217 | B1 | 12/2001 | Burke et al. | |
| 6,340,047 | B1 | 1/2002 | Frey | |
| 6,464,462 | B2 | 10/2002 | Stathopoulos et al. | |
| 6,491,496 | B2 * | 12/2002 | Starkweather | 416/97 R |
| 6,607,356 | B2 * | 8/2003 | Manning et al. | 416/97 R |
| 6,672,836 | B2 * | 1/2004 | Merry | 416/97 R |
| 6,709,771 | B2 | 3/2004 | Allister | |
| 6,805,535 | B2 | 10/2004 | Tiemann | |
| 6,832,889 | B1 | 12/2004 | Lee et al. | |
| 6,910,864 | B2 | 6/2005 | Tomberg | |
| 6,960,060 | B2 | 11/2005 | Lee | |
| 6,966,756 | B2 | 11/2005 | McGrath | |
| 6,969,230 | B2 | 11/2005 | Shi et al. | |
| 6,974,308 | B2 | 12/2005 | Halfmann et al. | |
| 6,984,103 | B2 | 1/2006 | Lee et al. | |
| 7,011,502 | B2 | 3/2006 | Lee et al. | |
| 7,014,424 | B2 | 3/2006 | Cunha et al. | |
| 7,028,747 | B2 | 4/2006 | Widrig et al. | |
| 2001/0006600 | A1 * | 7/2001 | El-Nashar et al. | 416/92 |

* cited by examiner

*Primary Examiner*—Edward Look
*Assistant Examiner*—Ryan H Ellis

(57) ABSTRACT

A cooling arrangement (11) for a highly tapered gas turbine blade (10). The cooling arrangement (11) includes a pair of parallel triple-pass serpentine cooling circuits (80,82) formed in an inner radial portion (50) of the blade, and a respective pair of single radial channel cooling circuits (84,86) formed in an outer radial portion (52) of the blade (10), with each single radial channel receiving the cooling fluid discharged from a respective one of the triple-pass serpentine cooling circuit. The cooling arrangement advantageously provides a higher degree of cooling to the most highly stressed radially inner portion of the blade, while providing a lower degree of cooling to the less highly stressed radially outer portion of the blade. The cooling arrangement can be implemented with known casting techniques, thereby facilitating its use on highly tapered, highly twisted Row 4 industrial gas turbine blades that could not be cooled with prior art cooling arrangements.

14 Claims, 2 Drawing Sheets

COOLING ARRANGEMENT FOR A TAPERED TURBINE BLADE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This present invention relates to the field of turbine blades, and more particularly, the present invention relates to highly tapered and twisted turbine blades having internal cooling channels for passing cooling fluid to cool the turbine blades.

BACKGROUND OF THE INVENTION

Gas turbine engines include a compressor for compressing air, a combustor for mixing the compressed air with fuel and igniting the mixture, and a turbine assembly for producing power. Combustors often operate at high temperatures that may exceed 2,500 degrees Fahrenheit. Typical turbine combustor configurations expose turbine assemblies to these high temperatures. As a result, turbine blades must be made of materials capable of withstanding such high temperatures. In addition, turbine blades often contain cooling arrangements for additional thermal protection.

Typically, turbine blades are formed from a root at one end for engaging a shaft and an elongated radial portion forming an airfoil that extends outwardly from a platform coupled to the root. The blade is ordinarily composed of a tip opposite the root, a leading edge, and a trailing edge. The interior structure of most turbine blades typically contains cooling channels forming part of a cooling arrangement. The cooling channels in the blades receive air from the compressor of the turbine engine and pass the air through the blade. The cooling channels often include multiple flow paths. Centrifugal forces and air flow at boundary layers may result in localized hot spots. Localized hot spots, depending on their location, can reduce the useful life of a turbine blade.

The cooling scheme for a turbine blade will depend upon its location within the turbine. The temperature of the working fluid will decrease as the fluid expands through the turbine and imparts its energy to the machine in the form of shaft power. Thus, the first row of blades is subjected to the highest gas temperature, and each successive row is subjected to a sequentially lower gas temperature. In addition, each successive row of blades gets longer in the radial direction, and may include more taper in cross-sectional area from root to tip, and may include more twist about its radial axis from root to tip. Row 1 blades of current generation industrial gas turbines are coated with a ceramic thermal barrier coating material and also include internal cooling fluid passages; whereas no ceramic coating material and no active cooling is needed for Row 4 blades of the same machines. U.S. Pat. No. 6,910,864 discloses a cooling scheme for a Row 2 industrial gas turbine blade consisting of a series of generally radially oriented cooling holes passing through the blade interior.

BRIEF DESCRIPTION OF THE DRAWING

The invention is explained in the following description in view of the drawings that show.

DETAILED DESCRIPTION OF THE INVENTION

Figure 1:
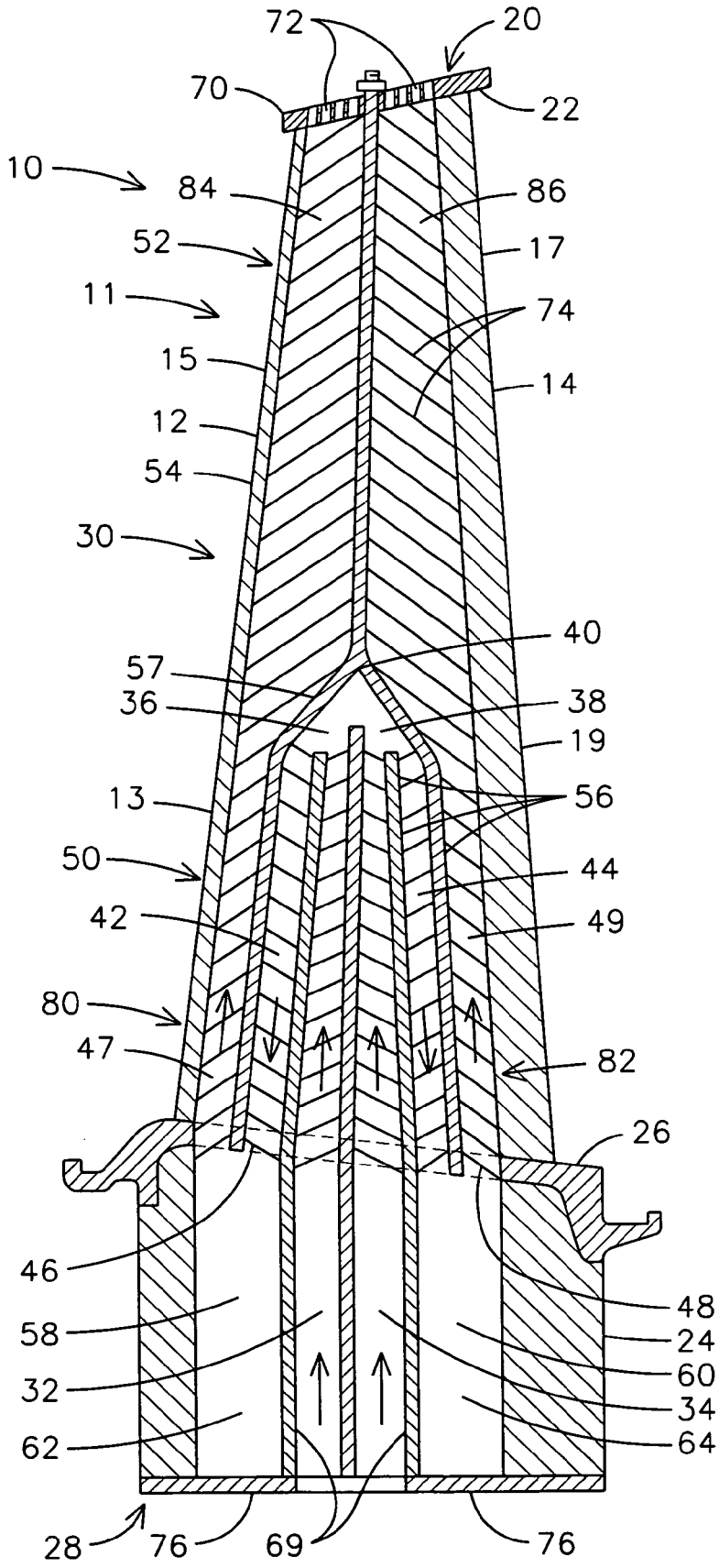
FIG. 1 is a cross-sectional view of an industrial gas turbine blade in accordance with one embodiment of the present invention.

The firing temperature of modern gas turbine engines continues to increase in response to the ongoing demand for improved energy efficiency. It is now desired to cool blades as far into the turbine as Row 4. The present inventor has recognized that known cooling arrangements for Row 2 turbine blades, such as U.S. Pat. No. 6,910,864 cited above, may be workable for some Row 3 blade designs, but they are not workable for typical fourth stage turbine blades because known manufacturing techniques for creating generally radially oriented cooling holes are not reliable for blades having a high degree of taper and/or twist. Furthermore, the present inventor has recognized that prior art radially oriented cooling schemes tend to provide a higher degree of cooling on the tip portion of a tapered blade because the cross-sectional area of the cooling flow paths represent a higher percentage of the airfoil cross-sectional area in the tip region than in the root region. The present inventor finds this to be counter-productive, because centrifugal loads are higher in the root portion of the blade, and therefore less material strength is available to accommodate thermal stress in the root portion than in the tip portion. The present inventor has thus endeavored to provide a cooling arrangement for highly tapered gas turbine blades that features an increased focus on cooling an inner radial portion of the turbine blade as compared with an outer radial portion of the turbine blade, and that can be implemented with known manufacturing techniques even when the blade is highly twisted.

Referring to the sole figure, a turbine blade 10 for Row 4 of an industrial gas turbine engine in accordance with one embodiment of the present invention will now be described. The turbine blade 10 includes a cooling arrangement 11 in inner aspects of the turbine blade for use in gas turbine engines. While the inventive cooling arrangement 11 is particularly well suited for a turbine blade 10, the cooling arrangement 11 may also be used in a stationary turbine vane. The cooling arrangement 11 is especially advantageous for gas turbine blades 10 with a root-to-tip cross-sectional area ratio of 4:1 or higher. The cooling arrangement 11 illustratively includes dual triple-pass serpentine cooling circuits 80,82 formed in a lower radial portion 50 of the blade 10, and receiving cooling fluid from a root portion 24 of the blade. The cooling arrangement 11 also includes a pair of single radial channel cooling circuits 84,86 formed in an upper radial portion 52 of the blade and receiving the cooling fluid from a respective one of the serpentine cooling circuit 80,82. This arrangement provides a higher degree of heat removal capability in the inner radial portion of the blade when compared to the heat removal capability in the outer radial portion of the blade. A first 84 of the pair of radial cooling circuits 84,86 is disposed to cool an upper leading edge portion 15 of the blade, and a second 86 radial cooling circuit is disposed to cool an upper trailing edge portion 17 of the blade. The gas turbine blade 10 illustratively includes a leading edge 12 and a trailing edge 14, and corresponding triple-pass serpentine cooling circuits 80,82 disposed to cool respective lower leading edge portion 13 of the blade and lower trailing edge portion 19 of the blade. The leading edge serpentine triple-pass cooling circuit 80 may have a higher heat load and/or average temperature than the trailing serpentine triple-pass cooling circuit 82 during operation of the gas turbine blade 10. Various cooling parameters of each respective triple-pass serpentine cooling circuits 80,82, such as mach number of cooling fluid through each respective triple-pass serpentine cooling circuit, number and/or type of turbulators, size dimensions, and flow rates may be adjusted as needed to counteract the respective heat loads and/or temperatures of each triple-pass serpentine cooling circuit during operation of the turbine blade 10. Although the sole figure illustrates a respective triple-pass serpentine cooling circuit adjacent each of the lower leading and trailing portions 13,19, other embodiments may feature additional serpentine structures and/or other than a triple-pass structure.

The turbine blade 10 further includes a generally concave pressure side (not shown) and a generally convex suction side (not shown) for coupling the leading edge to the trailing edge. More particularly, the turbine blade 10 includes a tip 20 at a first end 22, and a root 24 at a second end 26 longitudinally opposite the first end. The root 24 has a lower surface 28 positioned opposite from the second end 26. The turbine blade 10 may have a highly tapered shape, with the cross-sectional area of the airfoil proximate the second end 26 being much greater than the cross-sectional area of the airfoil proximate the first end 22, such as with a ratio of at least 4:1 in various embodiments.

The turbine blade 10 further includes a serpentine cooling path 30 in its radially inner portion having a plurality of pairs of channels and pairs of turns, where each pair of turns couples consecutive pairs of channels together. The plurality of pairs of channels include a pair of inflow channels 32,34 longitudinally extending from the root lower surface 28 between the leading edge 12 and the trailing edge 14 through the second end 26 and to a pair of inflow turns 36, 38 at an intermediate height 40 between the first and second end 22, 26. As shown in the exemplary embodiment of the figure, the pair of inflow channels 32,34 may extend longitudinally from the root lower surface 28 at approximately the midpoint between the leading edge 12 and trailing edge 14, although in other embodiments the pair of inflow channels may extend longitudinally from the root lower surface 28 at any region between the leading edge 12 and trailing edge 14. The turbine blade 10 further includes cover plates 76 for covering the lower surface 28 adjacent to the leading edge 12 and the trailing edge 14. The lower surface 28 includes a pair of openings continuous with the pair of inflow channels 32,34. As shown in the figure, the cover plates 76 do not block these openings to the pair of inflow channels 32,34.

As illustrated in the figure, the plurality of pairs of channels include a pair of intermediate channels 42,44 extending longitudinally from the pair of inflow turns 36,38 to a respective pair of root turns 46,48 adjacent to the second end 26. The pair of root turns 46, 48 extend from the pair of intermediate channels 42,44 into the root 24 adjacent the second end 26. The plurality of pairs of channels further include a pair of outflow channels 47,49 extending respectively adjacent to the leading edge 12 and the trailing edge 14 from the pair of root turns 46,48 to adjacent a radial position 54 between the first and second ends, as discussed below. The root turns 46,48 feature less aerodynamic weight, are easier to cast, and include less overall weight than prior art turns in serpentine cooling arrangements. Each root turn 46,48 may function as a manifold by receiving an outlet of a respective first intermediate channel 42, 44 and simultaneously feeding the cooling fluid to the respective outflow channel 47, 49, thereby providing less aerodynamic pressure loss than a prior art U-bend turn. Although the figure illustrates one pair of inflow channels, one pair of intermediate channels, one pair of outflow channels, as well as one pair of inflow turns and root turns, other embodiments may include other serpentine arrangements in the radially inner portion of the blade to provide a high degree of cooling for this highly stressed portion of the blade.

The pair of inflow turns 36,38 is positioned in a inner (lower) radial portion 50 of the turbine blade proximate a radial position 54 between the first 22 and second end 26 of the blade airfoil. An associated outer (upper) radial portion 52 of the turbine blade is positioned between the radial position 54 and the first end 22. The radial position 54 may be positioned at the midpoint between the first and second end 22,26, or it may be positioned above or below such midpoint, as is necessary to focus the cooling of the serpentine cooling paths that exist below such radial position. Selection of the location of radial position 54 is a design variable that may be manipulated as appropriate to account for the pattern of stresses encountered in the turbine blade. In the illustrated embodiment, the ratio of the number of channels positioned within the lower radial portion 50 of the turbine blade to the number of channels positioned within the upper radial portion 52 of the turbine blade is at least 2:1, and preferably 3:1, as is illustrated in the sole figure, with three pairs of channels (32,34) (42,44) (47,49) within the lower radial portion 50 and one pair of channels (84,86) within the upper radial portion 52. The effectiveness of the cooling provided by each channel is a function of the size of the channel, which in turn, is a function of the number of parallel channels that exist across the airfoil cross-section. Furthermore, the cooling fluid average temperature will be lower within the serpentine channels of the radial inner portion of the blade than in the radial channels of the radial outer portion of the blade, thereby further focusing the cooling capacity onto the most highly stressed portion of the blade.

Cooling fluid is directed through the serpentine cooling path 30, which is typically air received from a compressor (not shown), through the turbine blade 10 and out one or more exit orifices adjacent the first end 22. In the exemplary embodiment of the sole figure, the cooling fluid flows through the serpentine cooling path 30 and the pair of adjacent inflow channels 32,34 in a common direction. The cooling fluid is passed through the serpentine cooling path 30, including the pair of inflow channels 32,34 and the pair of intermediate channels 42,44 in the lower radial portion 50 of the turbine blade, after which the used cooling fluid is passed to the upper radial portion 52 of the turbine blade and outputted through exit orifices adjacent to the first end 22.

A plurality of ribs 56 positioned within the blade interior structure separate and defines the consecutive channels. The pair of root turns 46,48 extend into the root 24 from the pair of intermediate channels 42,44. The pair of root turns 46,48 include a pair of open root turns 58,60 within respective root cavities 62,64. Each respective root cavity 62,64 is defined by a root pressure side and a root suction side opposite from the root pressure side. Additionally, each respective root cavity 62,64 is further defined by a rib portion 69 extending into the root 24 to the lower surface 28 between each intermediate channel 42,44 and a respective adjacent inflow channel 32,34. Each open root turn 58,60 may form a free stream manifold for cooling fluid flowing through the serpentine cooling path 30.

As illustrated in the sole figure, a portion 57 of a rib 56 between the pair of intermediate channels 42,44 and at one end of the pair of outflow channels 47,49 may be arcuate. The arcuate portion of the rib between the pair of intermediate channels and the pair of outflow channels may be positioned at an intermediate height 40 to accommodate the transition from a higher number of channels in the inner radial portion to a lower number of channels in the outer radial portion for focused cooling of the lower radial portion of the turbine blade.

The turbine blade 10 may further include a first end shroud 70 adjacent to the first end 22. The first end shroud 70 includes a plurality of exit orifices 72 along the first end 22 for providing a plurality of outlets for used cooling fluid having passed through the turbine blade.

The channels may include a plurality of turbulators or trip strips 74 positioned along the sides of the channels in order to enhance mixing and cooling efficiency. The number, spacing, size and location of the trip strips 74 may be selected to optimize the degree of cooling achieved in the inner and outer radial portions of the cooling arrangement.

The turbine blade 10 may be manufactured by known casting techniques. Two halves of the turbine blade 10 may be manufactured separately and then joined along a cord line by any known joining technique, such as transient liquid phase bonding for example.

Operation of the cooling arrangement 11 provides two generally parallel cooling fluid flows through the blade interior, one through the leading edge portion and one through the trailing edge portion of the blade. Various cooling parameters such as channel size, number of channels, turbulators, etc. may be varied between these two parallel flows to optimize the cooling provided for the leading edge portion and the trailing edge portion. During operation, the cooling fluid flows through the openings in the lower surface 28 of the root 24, into the pair of inflow channels 32,34 and to the pair of inflow turns 36,38 adjacent an intermediate height 40 within a lower radial portion 50 of the turbine blade between the first end 22 and second end 26. As illustrated in figure, cooling fluid flowing through inflow channel 32 and to inflow turn 36 turns down into the intermediate channel 42 before entering the root turn 46, and an open root turn 58 extending from the intermediate channel 42 into a root cavity 62 within the root 24. Upon passing through the root turn 46, the cooling fluid enters the outflow channel 47 adjacent the leading edge 12. The cooling fluid enters a single radial channel cooling circuit 86 at an arcuate portion 57 of the rib adjacent the intermediate height 40 and between one end of the outflow channel 47 and the intermediate channel 42. The cooling fluid then passes through a plurality of exit orifices 72 in shroud 70 upon reaching the first end 22 and is discharged from the turbine blade 10. Based on the similar structure of the other pair of cooling flow channels, cooling fluid passing through the inflow channel 34 is similarly routed through the turbine blade 10 after it passes through the inflow channel 32, with the exception that the inflow turn 38 turns the cooling fluid toward the trailing edge 14, and thereby eventually causes the cooling fluid to pass through the single radial channel cooling circuit 86 adjacent the trailing edge 14.

Figure 2:
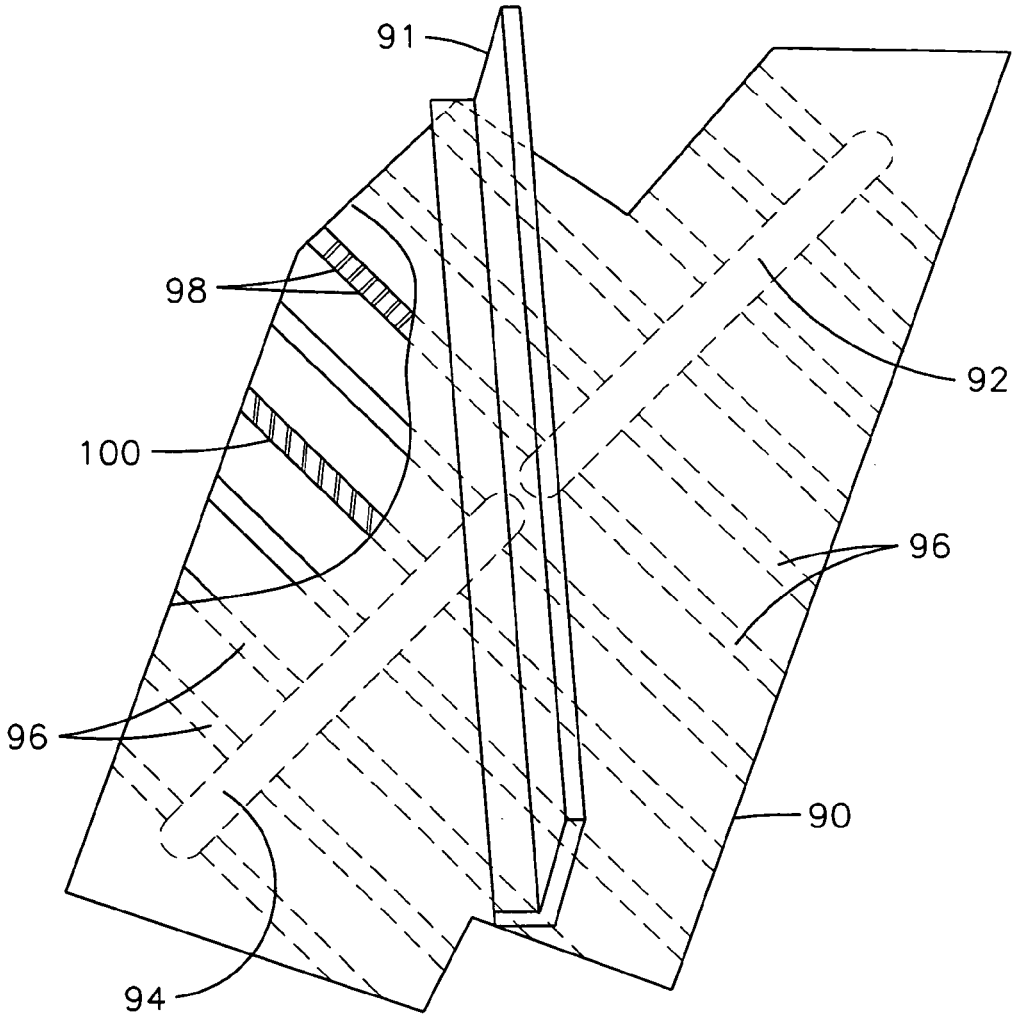
FIG. 2 is a partially sectioned top view of a cooled blade shroud that may be used with the blade cooling arrangement of the present invention.

FIG. 2 illustrates a cooled blade shroud 90 such as may be part of a cooling arrangement for an industrial gas turbine blade of the present invention. The cooled shroud 90 may be used in lieu of the shroud 70 on the blade illustrated in FIG. 1. The shroud 90 includes a tip rail 91 formed opposed the airfoil portion of the blade (not shown). The shroud includes a pair of cooling channels 92, 94 formed internal to the shroud and illustrated in phantom. The cooling channels 92, 94 are adapted to receive the cooling fluid exhausted from radial channel cooling circuits 84,86 respectively, when used on the blade of FIG. 1. A plurality of cooling holes 96 (also illustrated in phantom) are in fluid communication with the cooling channels 92, 94 for passing the cooling fluid through the body of the shroud 90 to respective exit points around the perimeter of the shroud 90. A portion of the shroud 90 is illustrated in a cut-away view to reveal laminar flow disruptors that optionally may be incorporated into some or all of the cooling holes 96 in order to improve heat transfer between the cooling fluid and the shroud 90. The flow disruptors may take the form of a plurality of turbulators 98 formed along the length of the hole 96 or a single helical rib 100 extending in a spiral pattern along the length of the hole 96, for example.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A cooling arrangement for a tapered industrial gas turbine blade having a root/tip cross-sectional area ratio of at least 4:1, the cooling arrangement comprising:

at least one serpentine cooling circuit formed in an inner radial portion of the blade said at least one serpentine cooling circuit including, a first serpentine cooling circuit in an inner radial portion of a leading edge portion of the blade, and a second serpentine cooling circuit in an inner radial portion of a trailing edge portion of the blade; and at least one single radial channel cooling circuit formed in an outer radial portion of the blade and fluidly connected to receive cooling fluid exhausted from the at least one serpentine cooling circuit, said at least one single radial channel cooling circuit including, a first single radial channel cooling circuit formed in an outer radial portion of the leading edge portion of the blade and fluidly connected to receive cooling fluid exhausted from the first serpentine cooling circuit;

a second single radial channel cooling circuit formed in an outer radial portion of the trailing edge portion of the blade and fluidly connected to receive cooling fluid exhausted from the second serpentine cooling circuit.

2. The cooling arrangement according to claim 1, wherein the at least one serpentine cooling circuit comprises a triple pass serpentine cooling circuit.

3. The cooling arrangement according to claim 1, wherein the at least one serpentine cooling circuit further comprises a root turn formed in a root portion of the blade.

4. The cooling arrangement according to claim 1, further comprising:

a cooling channel formed in a shroud of the blade for receiving the cooling fluid from the at least one single radial channel cooling circuit;

a plurality of cooling holes passing through the shroud and in fluid communication with the cooling channel; and at least one flow disruptor formed on a surface of at least one of the cooling holes.

5. A cooled, tapered, gas turbine blade comprising:

a root portion;

an airfoil portion extending from the root portion to a tip and comprising a root/tip cross-sectional area ratio of at least 4:1;

a pair of triple-pass serpentine cooling circuits formed in an inner radial portion of the airfoil portion and each adapted to receive a cooling fluid from the root portion, a first of the pair of triple-pass serpentine cooling circuits disposed to cool an inner radial leading edge portion of the blade and a second of the pair of triple-pass serpentine cooling circuits disposed to cool an inner trailing edge portion of the blade; and a pair of single radial channel cooling circuits formed in an outer radial portion of the blade and each receiving the cooling fluid exhausted from a respective one of the pair of triple-pass serpentine cooling circuits, a first of the pair of single radial channel cooling circuits disposed to cool an outer radial leading edge portion of the blade and a second of the pair of single radial channel cooling circuits disposed to cool an outer radial trailing edge portion of the blade.

6. The gas turbine blade according to claim 5, wherein a root-to-tip cross-sectional area ratio of the airfoil portion is 4:1 or higher.

7. The gas turbine blade according to claim 5, wherein the blade comprises two mating halves formed of respective individual castings and joined together to form the blade.

8. The gas turbine blade according to claim 5, wherein each of the triple-pass serpentine cooling circuits comprises a root turn formed as a respective hollow portion of the root portion.

9. The gas turbine blade according to claim 5, further comprising:

a shroud attached to the airfoil at the tip;

a pair of cooling channels formed in the shroud for receiving the cooling fluid from respective ones of the pair of single radial channel cooling circuits;

a plurality of cooling holes passing through the shroud and in fluid communication with each cooling channel; and at least one flow disruptor formed on a surface of at least one of the cooling holes.

10. A tapered blade for Row 4 of an industrial gas turbine engine, the blade comprising:

a root portion;

an airfoil portion extending from the root portion to a tip;

a means for cooling an inner radial portion of the airfoil portion; and a means for cooling an outer radial portion of the airfoil portion in fluid communication to receive a cooling fluid flow exhausted from the means for cooling the inner radial portion;

wherein the means for cooling an inner radial portion of the airfoil portion comprises a pair of triple-pass serpentine cooling circuits positioned in the inner radial portion of the airfoil and the means for cooling an outer radial portion of the airfoil portion comprises a pair of single radial channel cooling circuits, each single radial channel cooling circuit in fluid communication to receive a cooling fluid flow exhausted from a respective one of the pair of triple-pass serpentine cooling circuits.

11. The blade according to claim 10, wherein the airfoil portion further comprises a root/tip cross-sectional area ratio of at least 4:1.

12. The blade according to claim 10, wherein the triple-pass serpentine cooling circuits comprise a plurality of parallel radial channels fluidly connected via a manifold formed in the root portion.

13. The blade according to claim 10, wherein the means for cooling an outer radial portion of the airfoil portion receives the cooling fluid flow from the means for cooling the inner radial portion at about a midpoint of a radial span of the airfoil portion.

14. The blade according to claim 10, further comprising:

a shroud attached to the airfoil portion at the tip;

a cooling passage formed in the shroud for receiving the cooling fluid from the means for cooling an outer radial portion of the airfoil portion; and a flow disruptor formed on a surface of the cooling passage.

* * * * *